US006253398B1

(12) United States Patent
Yim

(10) Patent No.: US 6,253,398 B1
(45) Date of Patent: Jul. 3, 2001

(54) MATTRESS COVER

(76) Inventor: Kelly Yim, 96 Hancock St., Staten Island, NY (US) 10305-1252

( * ) Notice: Subject to any disclaimer, the term of this patent is extended or adjusted under 35 U.S.C. 154(b) by 0 days.

(21) Appl. No.: 09/501,030

(22) Filed: Feb. 9, 2000

(51) Int. Cl.[7] ..... A47C 31/00
(52) U.S. Cl. ..... 5/499; 5/497; 5/482; 5/922
(58) Field of Search ..... 5/482, 490, 497, 5/499, 922

(56) References Cited

U.S. PATENT DOCUMENTS

| | | | | |
|---|---|---|---|---|
| 2,066,252 | * | 12/1936 | Cohen, Jr. | 5/499 |
| 2,179,175 | * | 11/1939 | Cohen, Jr. | 5/499 |
| 2,343,260 | * | 3/1944 | Leader et al. | 5/499 |
| 2,543,552 | * | 2/1951 | Leader et al. | 5/499 |
| 3,317,933 | * | 5/1967 | Meyer et al. | 5/499 X |
| 3,605,143 | * | 9/1971 | Smith | 5/499 |
| 4,445,242 | | 5/1984 | Bowen | 5/484 |
| 4,646,375 | | 3/1987 | Parker | 5/498 |
| 4,651,371 | * | 3/1987 | Hahn | 5/497 |
| 5,020,177 | | 6/1991 | Etherington | 5/496 |
| 5,323,501 | * | 6/1994 | Kuhangel | 5/499 |
| 5,566,410 | | 10/1996 | Schaechter | 5/490 |
| 5,646,375 | | 7/1997 | Neuman | 177/54 |

* cited by examiner

*Primary Examiner*—Michael F. Trettel
*Assistant Examiner*—James M Hewitt
(74) *Attorney, Agent, or Firm*—Goldstein Law Offices P.C.

(57) ABSTRACT

A mattress cover, for covering a standard mattress, having a major portion and a minor portion. The major portion has a major pocket which defines a rectangular volume. The minor portion has a minor pocket which defines a rectangular volume. The major pocket and minor pocket are separated by a three edge split and are joined by a top sheet. One side of the mattress is inserted into the major pocket, and then the minor portion is pulled over the opposite portion, fully encasing the mattress therein. Fastener material joins the major and minor portions to keep the cover securely in place.

7 Claims, 3 Drawing Sheets

MATTRESS COVER

BACKGROUND OF THE INVENTION

The invention relates to a mattress cover. More particularly, the invention relates to a covering for a mattress in lieu of a fitted sheet, which fully encases the mattress so as to stay securely in place during use.

In conventional bedding arrangements, mattresses are covered with a fitted sheet, and then are covered with a flat sheet, a comforter, and other bedding materials. A typical fitted sheet has a rectangular top, and has four sides which meet at elastic corners. To apply the sheet onto the bed, one of the corners is placed over one of the corners of the mattress, and then the sheet is stretched across to the opposite corner of the mattress so that the cover corners are placed just beneath the mattress corners. Then the remaining cover corners are stretched over the two remaining mattress corners so that all four cover corners extend slightly beneath the mattress. The cover is thus held in place by the tension between the opposite corners.

However, since the elastic remains tensioned once it has been applied onto the mattress, it has the tendency to "pop up" off the corner. When the sheet has shrunk from repeated washings and its corners cannot reach underneath the mattress, they have a much greater tendency to pop up. In addition, mattress covers for children's beds have an even greater tendency to ride up, since children often move around a great deal.

Some have attempted to deal with the problem of the ever-moving bed sheet by using straps which extend around the mattress, ropes which tie to the bed frame, Velcro pads and snaps which attach the bottom of the sheet to the bed frame, and more. While these units may be suitable for the particular purpose employed, or for general use, they would not be as suitable for the purposes of the present invention as disclosed hereafter.

SUMMARY OF THE INVENTION

It is an object of the invention to produce a mattress covering which replaces a standard bed sheet. Accordingly, a mattress covering is provided which fully covers the upper surface of a standard mattress.

It is another object of the invention to provide a mattress covering which is easy to apply, and which will stay in place until removed by the user. Accordingly, the mattress covering extends fully over the mattress like a pillowcase, and fastens at the bottom surface thereof. The mattress covering is easily removed by unfastening at the bottom, and pulling the cover perpendicularly away from one side of the mattress and then removing the cover from the opposite side of the mattress.

The invention is a mattress cover, for covering a standard mattress, comprising a major portion and a minor portion. The major portion has a major pocket which defines a rectangular volume. The minor portion has a minor pocket which defines a rectangular volume. The major pocket and minor pocket are separated by a three edge split and are joined by a top sheet. One side of the mattress is inserted into the major pocket, and then the minor portion is pulled over the opposite portion, fully encasing the mattress therein. Fastener material joins the major and minor portions to keep the cover securely in place.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
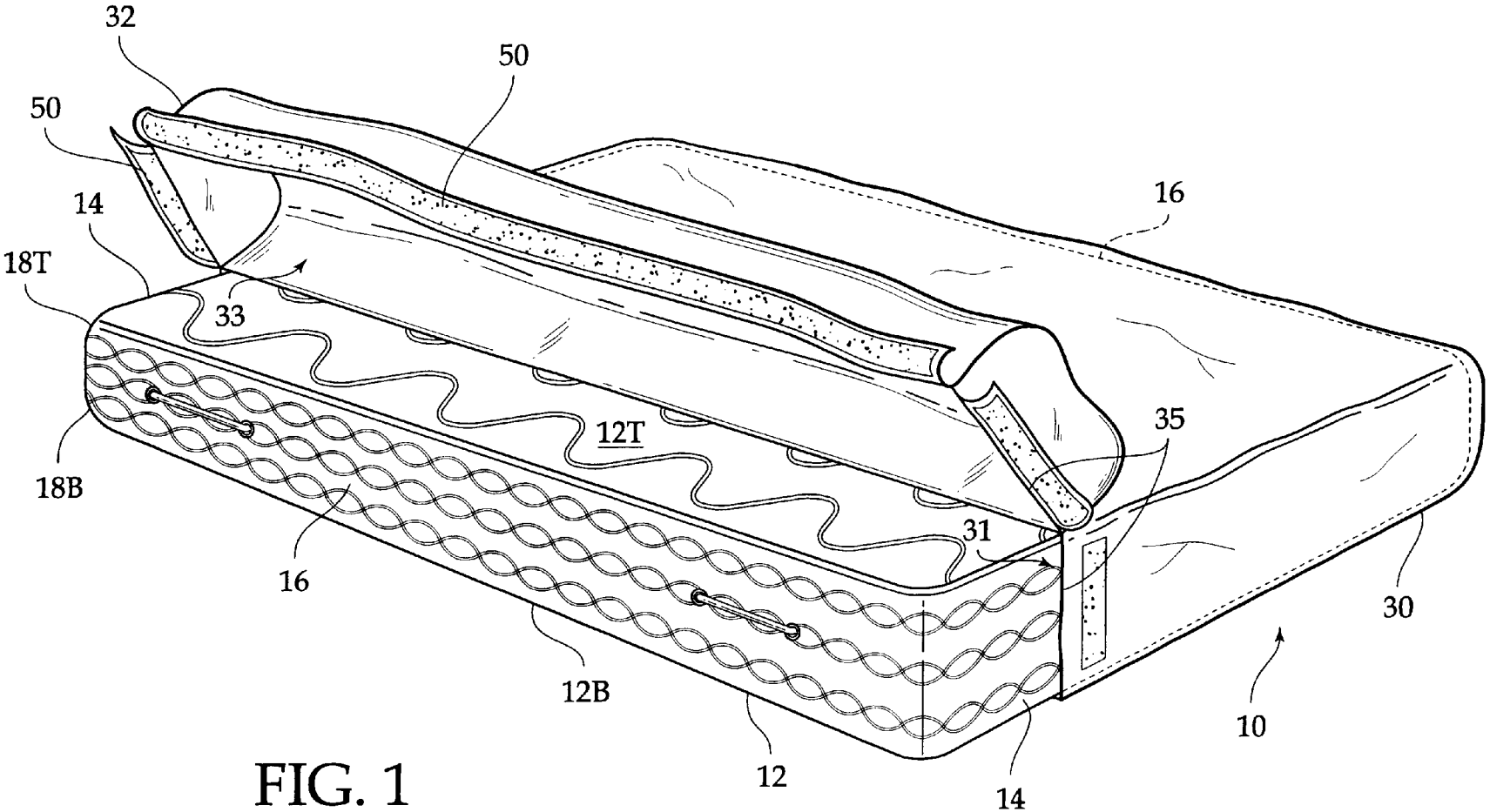
FIG. 1 is a diagrammatic perspective view, illustrating the cover partially installed on a standard mattress with a portion of the mattress broken away, wherein the major portion of said cover is fully installed on said mattress, and the minor portion of said cover is not installed on the said mattress.

FIG. 1 illustrates a mattress covering device 10, also referred to herein as a mattress cover, extending partially over a standard mattress 12. The mattress cover is made of a flexible, soft material, fabric-like in nature.

The standard mattress 12 is in the shape of a rectangular prism, having a top surface 12T, a bottom surface 12B, a first pair of parallel sides 14, and a second pair of parallel sides 16. For most standard mattress sizes, one of the pairs of parallel sides will be longer than the other pair of parallel sides. The mattress 12 also has top corners 18T where the parallel sides meet the top surface 12T, and bottom corners 18B where the parallel sides meet the bottom surface 12B. The top corners 18T and bottom corners 18B of the mattress 12 are generally rounded.

Figure 2:
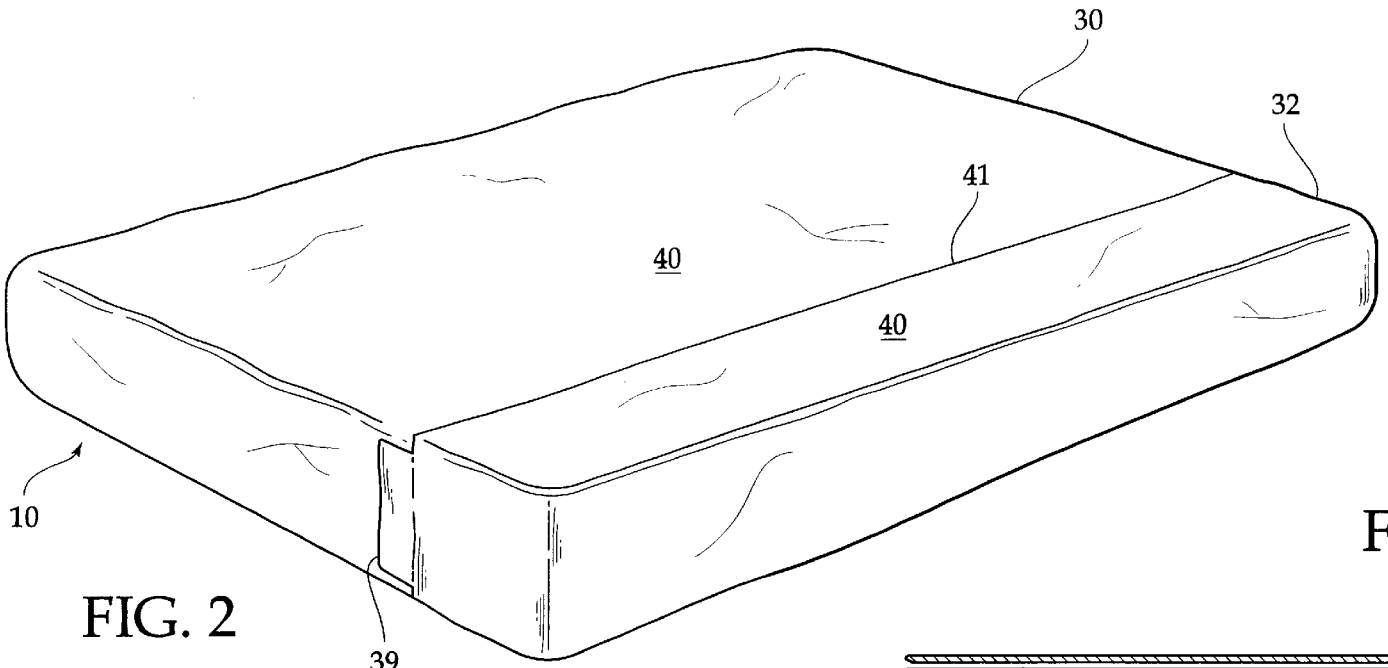
FIG. 2 illustrates the cover fully installed on the mattress and secured thereon.
Figure 4:
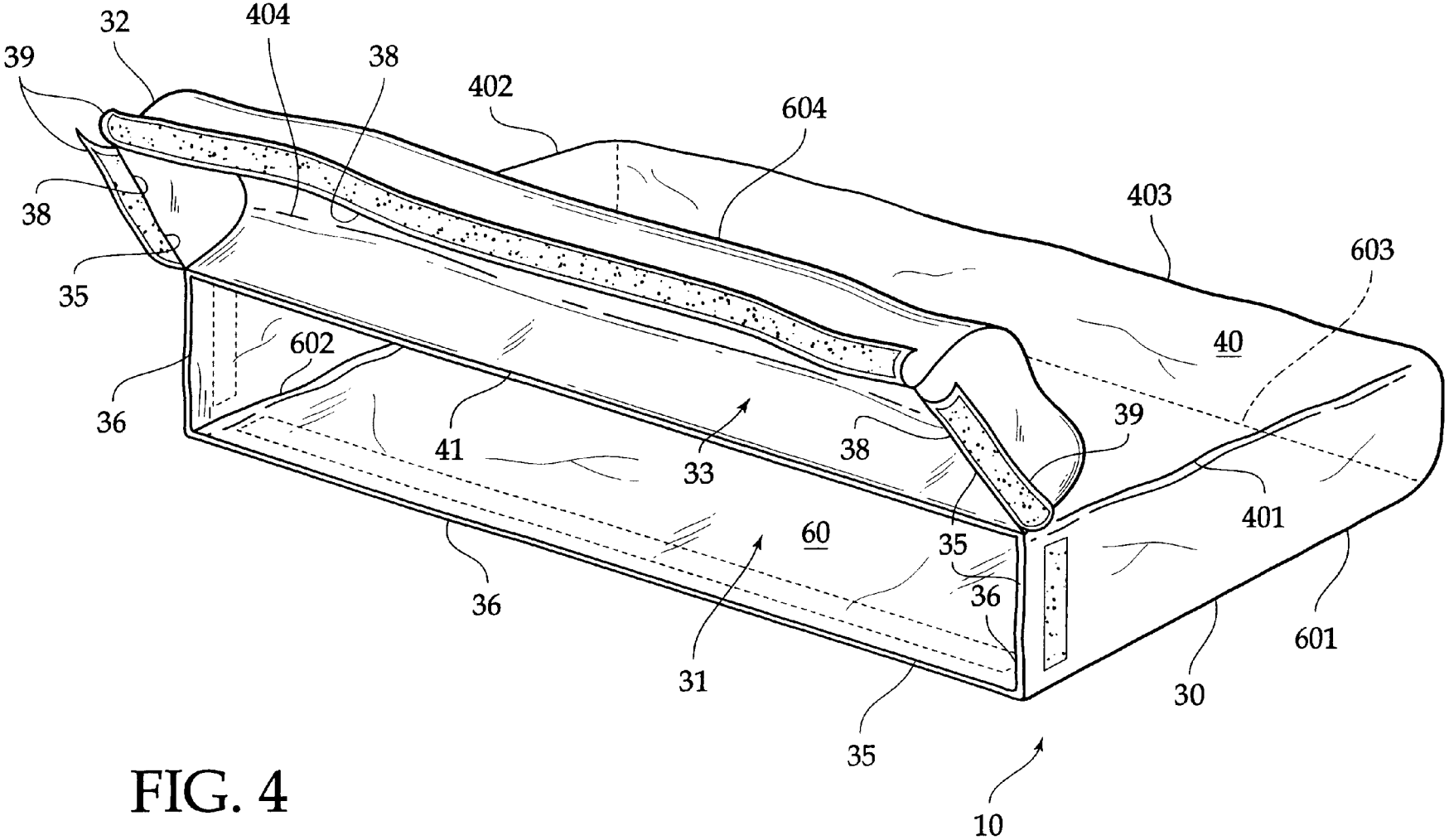
FIG. 4 is a diagrammatic perspective view, illustrating just the mattress cover, per se.

FIG. 4 illustrates just the mattress cover 10. Said mattress cover is the shape of a hollow rectangular prism, having a major portion 30 and a minor portion 32. Referring momentarily to FIG. 2, a top sheet 40 is common to both the major portion 30 and minor portion 32. The major portion 30 and minor portion 32 meeting at a crease 41 in said top sheet, which may be an actual crease or a just conceptual at which the major portion 30 and minor portion 32 meet. Referring again to FIG. 4, the major portion 30 and minor portion 32 are in effect "hinged" at the crease 41. The major portion 30 defines a rectangular volume which may be referred to as a major pocket 31. The minor portion 30 also defines a rectangular volume which may be referred to as a minor pocket 33 .

Figure 3:
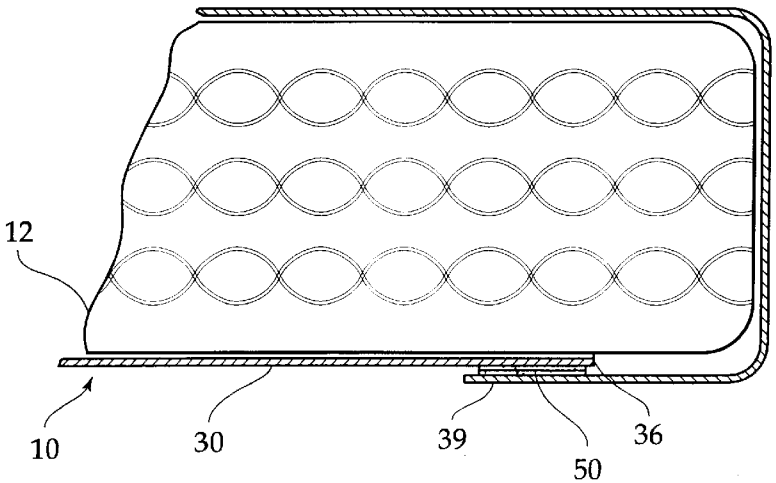
FIG. 3 is a cross sectional view of the cover installed on the mattress with the fastening device securing the major and minor flaps.

The major portion 30 and minor portion 31 are separated by a three edged split 35 which meets both ends of the crease 41. The split 35 separates a major split edge 36 from a minor split edge 38. In addition, three minor flaps 39 extend beyond the minor split edge 38. Referring to FIG. 2 and FIG. 3, the minor flaps 39 overlap the major portion 30, extending beyond the major split edge 36. In addition, fastener material 50 is affixed to both the major portion 30 adjacent to the major split edge 36 and on the minor flaps 39. Accordingly, the minor flaps 39 are affixed to the major portion 30 with the fastener material 50 to help keep the mattress cover 10 in place on the mattress.

Referring once again to FIG. 4, the mattress cover 10 includes a bottom sheet 60 which extends substantially parallel to the top sheet 40. The top sheet has a top sheet first edge 401, and a top sheet second edge 402 which is parallel to said first top edge. The top sheet 40 also has a top sheet third edge 403 which is perpendicular to said top sheet first edge 401, and a top sheet fourth edge 404 which is parallel to said top sheet third edge 403. The top sheet first edge 401 and top sheet second edge 402 are substantially the same is length as the first pair of parallel sides 14 of the mattress. The top sheet third edge 403 and top sheet fourth edge 404 are substantially the same in length as the second pair of parallel sides 16 of the mattress.

The bottom sheet 60 has a bottom sheet first edge 601 and a bottom sheet second edge 602 extending parallel thereto. The bottom sheet 60 also has a bottom sheet third edge 603 which extends perpendicular to and between the bottom sheet first edge 601 and the bottom sheet second edge 602.

The three edges of the split 35 are defined as follows: one edge of the split 35 extends from the top sheet first edge 401 to the bottom sheet first edge 601. Another edge of the split 35 extends from the bottom sheet first edge 601 to the bottom sheet second edge 602. The final edge of the split 35 extends from the bottom sheet second edge 602 to the top sheet second edge 402. All edges of the split 35 extend parallel to the top sheet third edge 403. The crease 41 joins opposite edges of the split 35.

To install the mattress cover 10, referring once again to FIG. 1, one side of the mattress in inserted into the major pocket 31 of the major portion 30. Then the minor portion 32 is pulled over an opposite side of the mattress—fully encasing the mattress in both the major pocket 31 and minor pocket 33. Then, the fastening material 50 is used to connect the major pocket 31 to the minor pocket 33 along the slit 35 to ensure that the mattress cover 10 remains in place while the mattress is used.

In conclusion, herein presents a mattress cover which replaces a standard bed sheet to provide an effective solution for covering a mattress such that the cover remains securely in place until removed by the user.

What is claimed is:

1. A mattress covering device, for use with a standard mattress having a top surface, a bottom surface, a first pair of parallel sides and a second pair of parallel sides, the device comprising:

a hollow rectangular prism made of a flexible, fabric material, defined by:

a top sheet having a top sheet first edge, a top sheet second edge parallel to said top sheet first edge, a top sheet third edge perpendicular to said top sheet first edge, a top sheet fourth edge parallel to said top sheet third edge, the top sheet first edge and top sheet second edge substantially the same in length as the first pair of parallel sides of the mattress, the top sheet third edge and top sheet fourth edge substantially the same in length as the second pair of parallel sides of the mattress;

a bottom sheet having a bottom sheet first edge, a bottom sheet second edge parallel to said bottom sheet first edge; and wherein a split extends from the top sheet first edge to the bottom sheet first edge, between the bottom sheet first edge and bottom sheet second edge, and between the bottom sheet second edge and top sheet second edge, said split located between the top sheet third edge and top sheet fourth edge such that the rectangular prism is thus divided into a major portion and a minor portion which together extend fully over the standard mattress such that the major portion and minor portion do not overlap at said split.

2. The mattress covering device as recited in claim 1, wherein the major portion has a major split edge extending along the split, the minor portion has a minor split edge extending along the split, and wherein the device further comprises at least one minor flap attached to the minor split edge in order to overlap the major portion and extend beyond the major split edge.

3. The mattress covering device as recited in claim 2, wherein fastener material is attached to both the at least one minor flap and the major portion immediately adjacent to the major split edge for fastening the minor flap to the major portion.

4. The mattress covering device as recited in claim 3, wherein the minor portion comprises three minor flaps which each fasten to the major portion near the major split edge.

5. A mattress covering device, for covering a standard mattress, the mattress having a top surface, a bottom surface, and parallel sides, the device comprising:

a major portion, forming a major portion pocket;

a minor portion, forming a minor portion pocket, the major portion and minor portion fully encasing the mattress with the mattress extending into both the major portion pocket and minor portion pocket;

a split separating the major portion and minor portion on three sides, wherein the major portion and minor portion do not overlap at said split and the major portion and minor portion connected by a top sheet continuous between said major portion and minor portion such that the major portion is hinged to the minor portion with the top sheet.

6. The mattress covering device as recited in claim 5, further comprising fastener material for securing the major portion to the minor portion along the split.

7. The mattress covering device as recited in claim 6, wherein at least one minor flap located along the split and attached to the minor portion for overlapping the major portion, wherein the fastener material is located on the minor flap.

* * * * *